United States Patent [19]

Palau et al.

[11] 4,250,930

[45] Feb. 17, 1981

[54] READING DEVICE FOR DOBBIES OR OTHER WEAVING MECHANISM

[75] Inventors: Joseph Palau, Duingt; Jean-Paul Froment, Doussard, both of France

[73] Assignee: Societe Anonyme des Etablissements Staubli, Faverges, France

[21] Appl. No.: 15,264

[22] Filed: Feb. 26, 1979

[30] Foreign Application Priority Data

Jun. 16, 1978 [FR] France ..... 78 19230

[51] Int. Cl.[3] ..... D03D 51/00

[52] U.S. Cl. ..... 139/324; 139/329

[58] Field of Search ..... 139/1 E, 71, 72, 324, 139/329, 333; 66/231, 238, 239

[56] References Cited

U.S. PATENT DOCUMENTS

| | | | |
|---|---|---|---|
| 3,101,749 | 8/1963 | Pfarrwaller | 139/329 |
| 3,318,341 | 5/1967 | Nollet | 139/1 E |
| 4,067,364 | 1/1978 | Tomio | 139/329 |

*Primary Examiner*—Henry Jaudon

*Attorney, Agent, or Firm*—Dowell & Dowell

[57] ABSTRACT

In a reading device for dobby or other weaving mechanism with double swinging levers and retaining hooks, of the type in which said hooks are actuated by a disc with radial lugs or the equivalent, at least one input gear connected for rotation with the shaft of the mechanism and meshing with an intermediate gear carried by a mobile member which can be displaced concentrically with respect to the axis of said input gear, and which intermediate gear meshes with an output gear in turn with the lug disc coupled for rotation and carried by a supporting lever associated with yieldable means operative to maintain said output gear in mesh with the intermediate gear, so that by selectively angularly displacing the mobile member about the input shaft, it is possible either to achieve a simple angular shift of the lug disc to allow for unweaving during reverse motion, or alternatively to achieve the retraction of said lug disc away from the heels of the hooks in order to level all of the heddle frames.

2 Claims, 5 Drawing Figures

READING DEVICE FOR DOBBIES OR OTHER WEAVING MECHANISM

The present invention relates to reading devices for loom dobbies or other weaving mechanisms, and relates more particularly (as is of greater interest in this case), but not exclusively, to those devices in which the control of the articulated retaining hooks associated with the conventional double swinging levers actuating the heddle mechanism, is achieved by a disc with radial lugs or by an equivalent system with tabs as shown in U.S. Pat. No. 3,441,060.

It is known that, in card reading devices of the type in question, a disc with radial lugs is usually driven with the aid of a chain or gear mechanism connected to the shaft of the mechanism. However, with a view to improving the use of the dobbies, the conventional mechanism has also had to be improved so as to allow weft unweaving and heddle frame levelling operations. The first consists in angularly shifting the disc with radial lugs or the like, with a view to preserving the loom-dobby synchronisation during reverse motion as discussed in column one of U.S. Pat. No. 4,067,364. For levelling purposes, all the heddle frames of the mechanism must be brought into low position.

Under these conditions, differential drive mechanisms have been devised which effectively permit modifying the position of the disc with radial lugs with respect to the heels actuating the articulated retaining hooks, but the constructions proposed in the prior art are very complex and have proved to be unreliable, misadjustments or damage being frequent.

The improvements forming the subject matter of the present invention envisage remedying this drawback by providing a reading device which complies particularly well with the various requirements of the art.

In accordance with the invention, the reading device is provided with at least one input gear which is angularly driven by the shaft of the mechanism and which meshes with an intermediate gear carried by a mobile member shiftable concentrically about the axis of said input gear; this intermediate gear itself meshes with an output gear fixed to rotate with the disc with radial lugs and carried by an actuating lever urged by yieldable means which serve to maintain said output gear always in mesh with the intermediate gear, so that by angularly displacing the mobile member which carries this latter gear and which is equipped to this end with a suitable shifting lever, either a simple angular shift of the lug disc is obtained during unweaving, or else the withdrawal of said disc from contact with the heels of the hooks can be had with a view to heddle frame levelling, depending on the amplitude of this displacement.

It is appreciated that such a reading device is of simple and robust construction, so that it is highly reliable and is of low initial cost. Its functioning and practical use are entirely satisfactory since the disc with radial lugs or the like remains in all events connected to the shaft of the dobby or other mechanism, this avoiding any risk of loss of synchronization.

The invention will be more readily understood on reading the following description with reference to the accompanying drawings, in which.

Figure 1:
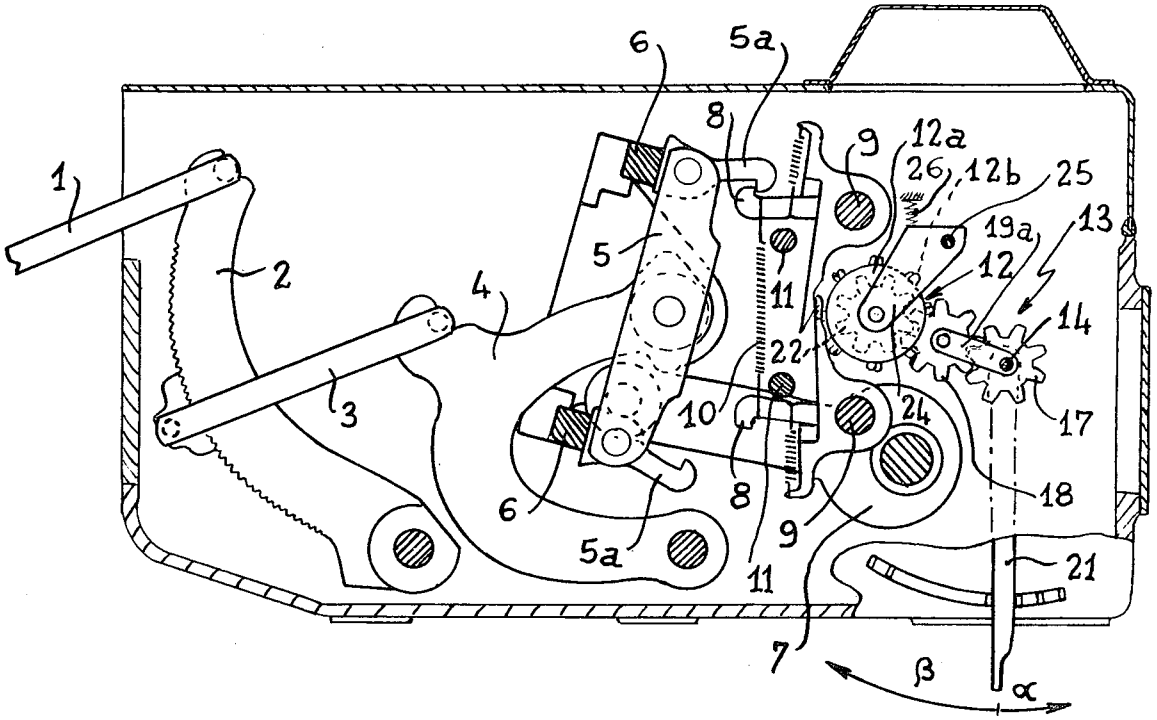
FIG. 1 is a elevational section through a dobby equipped with a reading device according to the invention.

Referring now to the drawings, reference 1 of FIG. 1 designates one of the drawing arms of the dobby in question; this arm 1 is pivoted at the end of a suspension swinging lever 2 connected by an adjustable link 3 to a lower lever 4 which pivotally carries a double swinging lever 5. Each double swinging lever 5 of the dobby is actuated in reciprocating motion by two bars 6 receiving their reciprocating movement from an eccentric mechanism 7. At each of the ends of the double swinging levers 5 there is provided a nose hook **5*a* adapted to cooperate with a corresponding retaining hook 8 pivoted on a horizontal pin 9. Spring means 10 tend to return these hooks 8 against fixed stops 11, so that the heel of each hook 8 is thus applied against the disc 12 with radial lugs of the reading device 13** of the dobby.

Figure 2:
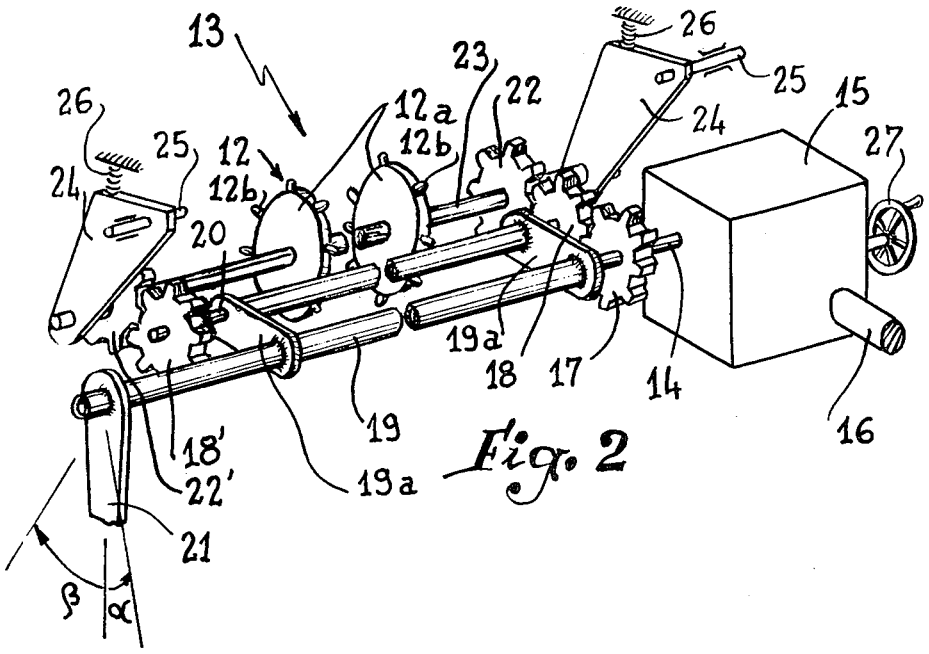
FIG. 2 is a perspective view showing the general arrangement of this device.

In accordance with the invention and as illustrated in FIG. 2, this reading device 13 comprises a horizontal shaft 14 connected, via a bevel gear and disengagement mechanism, shown diagrammatically at 15, to the shaft of the dobby or to a shaft 16 synchronized angularly with the latter. An input gear 17 is fixed on the shaft 14, which gear meshes with an intermediate gear 18 carried by a shaft 20 supported by a mobile member 19. The mobile member 19 comprises two lateral levers **19*a* connected by two tubular longitudinal members of which one is mounted idly on an extension of the shaft 14 whilst the other encloses and supports the shaft 20 on which gear 18 is fixed. The mobile member 19 is provided at its end with a manoeuvring lever 21 accessible from outside the dobby. It should be appreciated that the angular displacement of this lever 21 makes it possible, by concentric pivoting of the member 19 on the shaft 14, to modify the position of the gear 18 with respect to gear 17**, these two gears always remaining in mesh with each other.

The intermediate gear 18 meshes with an output gear 22 fixed on the shaft 23 which supports the disc elements **12*a*, of which the whole constitutes the above-mentioned disc 12 with radial lugs. The ends of this shaft 23 are mounted in two actuating levers 24 pivotally supported on pins 25 suitably supported by the walls of the frame or casing of the dobby. Yieldable means, shown schematically in FIG. 2 in the form of two springs 26, tend to urge the actuating levers 24 to move the shaft 23 in the direction of the mobile member 19 and thus to maintain the gears 22 and 18** in mesh.

It will be noted that, in the embodiment in question, it has been shown that the reading device 13 further includes a second set of intermediate gear and output gear, referenced 18' and 22' and fixed to the other ends of the shafts 20 and 23, but this assembly is in no way compulsory and does not modify the functioning of the whole in any way.

To set forth this functioning and the use of the device 13, reference will be made to the diagrams of FIGS. 3, 4 and 5 in which the meshing gears 17, 18 and 22 have been shown as circles corresponding to the root diameter of each of said gears.

Figure 3:
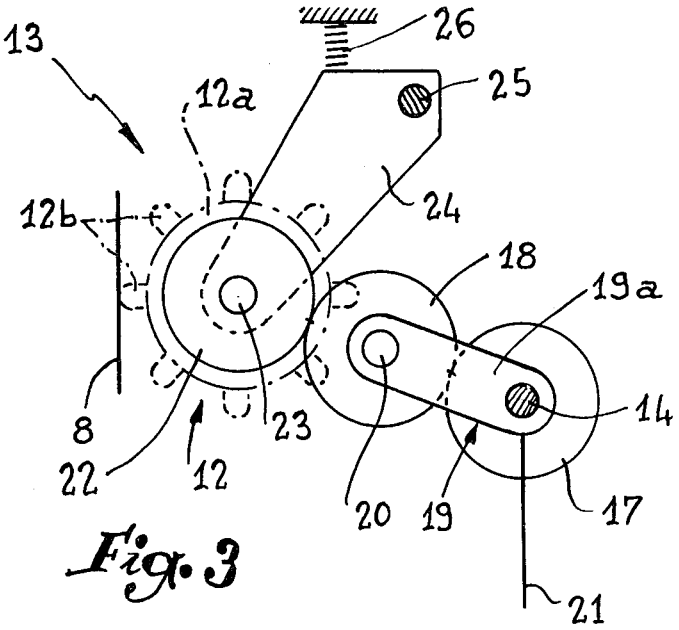
FIGS. 3 to 5 are diagrams illustrating the functioning and use of the device according to FIGS. 1 and 2.

FIG. 3 shows the parts of the reading device during normal functioning of the dobby. The mobile member 19 is in its normal operating position wherein the shafts 14, 20 and 23 are disposed in a straight line; the rotation of shaft 14 is transmitted to shaft 23 and to the disc 12 with radial lugs, so that said lugs control the heels of the hooks 8 and the double swinging levers 5 as a function of the desired weave for the fabric to be made.

Figure 4:
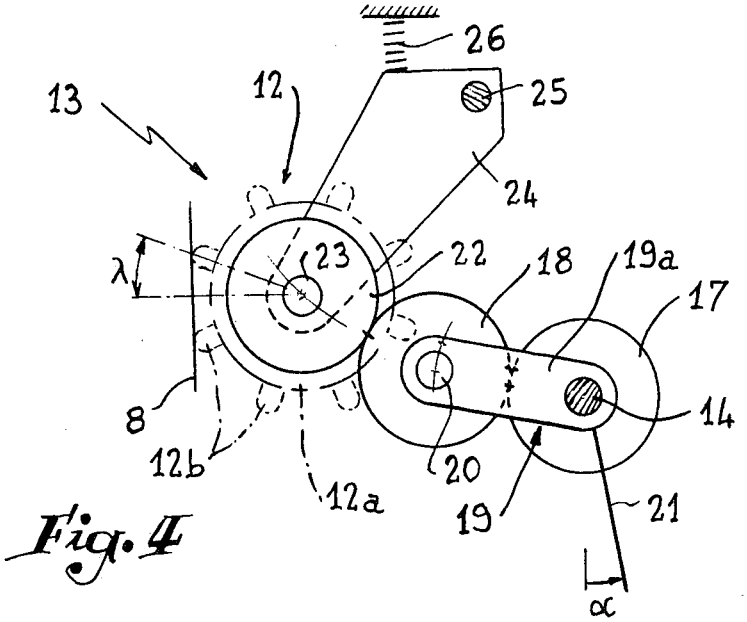

In FIG. 4, it has been assumed that the operator has shifted the lever 21 by an angle $\alpha$. This shifting naturally modifies the orientation of the mobile member 19 and displaces the gear 18 on the toothed periphery of the gear 17 which continues to drive said gear 18. This additional displacement of the gears 18 and 18' is obviously transmitted to the output gears 22 and 22' so that the disc 12 with radial lugs is rotated through an angle $\lambda$ with respect to its position corresponding to FIG. 3. This angular shift consequently compensates for reverse motion during unweaving, the dobby-loom synchronisation maintained although the loom has been reversed.

It is obvious that the shafts 14, 20 and 23 define in this position an obtuse angle, but the amplitude of the angular displacement of the member 19 is still relatively small, so that the lugs **12*b* of the disc 12 still come into contact with the heels of the hooks 8 for controlling same. To return to normal weaving after unweaving the weft, it suffices for the operator to return the lever 21 into the initial normal operating position (position marks being provided to this end) whereby the three shafts 14, 20 and 23 return to the aligned position of FIG. 3**, without any risk of inaccurate shifting.

Figure 5:
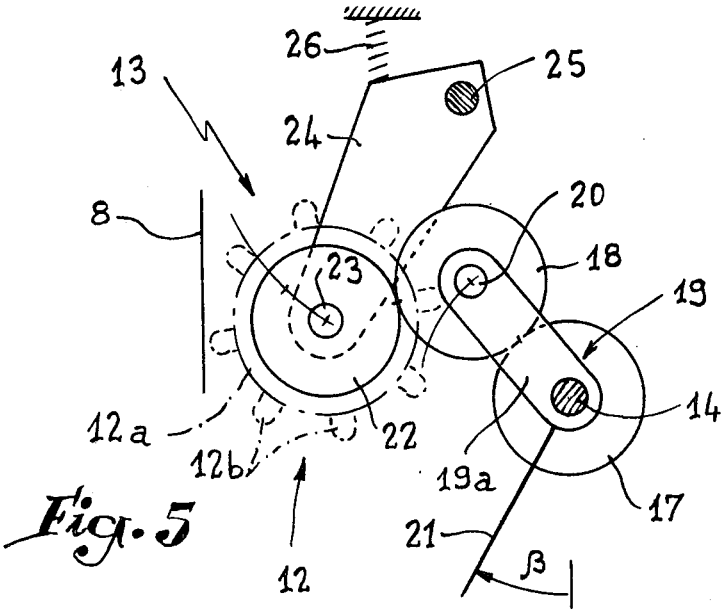

When it is desired to level the needles, the lever 21 is shifted through the angle $\beta$ of FIGS. 2 and 5, this angle being larger than angle $\alpha$ mentioned above. The pivoting of the levers **19*a* of the mobile member 19 causes an angular displacement of the intermediate gear 18 about the input gear 17 and consequently of the output gear 22, maintained applied by the springs 26 against the preceding one, so that the disc 12 moves rightwardly into a retracted position, its lugs 12*b* no longer being in contact with the heels of the the hooks 8 which remain against the stops 11 of the dobby so that all of the heddle frames are simultaneously leveled. The reading device 13 is separated from the retaining hooks 8 and the double swinging levers 5, whilst still remaining connected to the shaft of the dobby by the shafts 14 and 16. However, it will be noted that this connection may be broken by manipulating the mechanism 15 to disconnect the shafts 14 and 16, the further positioning of the reading device then being accomplished with the aid of a handwheel such as 27 (FIG. 2**).

There again, the return of the lever 21 to the position of normal functioning returns the gears into coplanar alignment.

It will be appreciated that the invention may advantageously be applied to other reading devices in which the actuation of the retaining hooks is accomplished by a chain with lugs or with other equivalent tabs.

What is claimed is:

1. In a reading device for a loom dobby having double swinging levers and retaining hooks and having rotating means having radially extending lugs operative to contact and selectively actuate the retaining hooks, improved means for driving the rotating means from the dobby shaft comprising:

an input shaft coupled to said dobby shaft and having an input gear fixed thereon;

an output shaft disposed parallel to said input shaft and having an output gear fixed thereon, the output shaft carrying said rotating means fixed thereon;

an intermediate shaft disposed parallel to said input and output shafts and located between them and carrying an intermediate gear meshing with both the input gear and with the output gear;

means supporting the output shaft and including yieldable means urging the output shaft away from said retaining hooks and toward said intermediate shaft to maintain the output gear always in contact with the intermediate gear; and mobile support means pivotally mounted on the input shaft and supporting the intermediate shaft with the intermediate gear in mesh with the input gear, whereby the mobile support means can be tilted about the input shaft from a normal weaving position selectively to an unweaving position wherein the loom is reversed and the relative angular positions of the input and output shafts are shifted, or to a heddle frame leveling position wherein the rotating means is retracted to move the lugs fully out of contact with the hook means.

2. The reading device as claimed in claim 1, further including a manoeuvring lever fixed at right angles to the mobile support means and extending outside the dobby and operative selectively to move the mobile support means between said normal position, said unweaving position, and said needle leveling position.

* * * * *